US011389939B2

(12) United States Patent
Chen

(10) Patent No.: US 11,389,939 B2
(45) Date of Patent: Jul. 19, 2022

(54) BREAKER HAMMER FOR BREAKING HARD OBJECTS

(71) Applicant: LUCKY-BRAND INDUSTRIAL CO., LTD., Taichung (TW)

(72) Inventor: Ying-Chieh Chen, Taichung (TW)

(73) Assignee: LUCKY-BRAND INDUSTRIAL CO., LTD., Taichung (TW)

( * ) Notice: Subject to any disclaimer, the term of this patent is extended or adjusted under 35 U.S.C. 154(b) by 27 days.

(21) Appl. No.: 16/833,838

(22) Filed: Mar. 30, 2020

(65) Prior Publication Data

US 2021/0260742 A1 Aug. 26, 2021

(30) Foreign Application Priority Data

Feb. 21, 2020 (TW) ..... 109105737

(51) Int. Cl.
*B25D 1/14* (2006.01)

(52) U.S. Cl.
CPC ..... *B25D 1/14* (2013.01)

(58) Field of Classification Search
None
See application file for complete search history.

(56) References Cited

U.S. PATENT DOCUMENTS 2,086,694 A * 7/1937 Beegle ..... B25D 1/00 81/26
2,778,256 A * 1/1957 Molnar ..... B25D 1/00 72/479
2,906,150 A * 9/1959 Stewart ..... B25D 1/02 72/466.6
3,961,519 A * 6/1976 Kurata ..... B21D 1/06 72/466.6

* cited by examiner

*Primary Examiner* — Brian D Keller
(74) *Attorney, Agent, or Firm* — Muncy, Geissler, Olds & Lowe, P.C.

(57) ABSTRACT

A breaker hammer for breaking hard objects includes one or multiple striking faces. One striking face has a breaking portion inside. The breaking portion occupies about 80% of the area of the striking face. The breaking portion has a plurality of striking areas protruding from the striking face, thereby effectively striking and breaking hard objects.

1 Claim, 4 Drawing Sheets

BREAKER HAMMER FOR BREAKING HARD OBJECTS

BACKGROUND OF THE INVENTION

1. Field of the Invention

The present invention relates to hammers and more particularly, to a breaker hammer for breaking hard objects.

2. Description of the Related Art

The general hammer usually has a flat striking surface. The force generated by swinging the hammer allows the striking surface to strike or impact the object, such as nails, or to make the surface of the object impact the desired shape and structure.

However, if the object to be struck by the hammer is a relatively hard material, it often happens that even if the weight of the hammer or the force of swinging the hammer is increased, the hard object cannot be effectively broken.

SUMMARY OF THE INVENTION

The present invention has been accomplished under the circumstances in view. It is the main object of the present invention to provide a breaker hammer, which can effectively strike and break hard objects in addition to its general use.

To achieve this and other objects of the present invention, a breaker hammer for breaking hard objects comprises at least one striking face. One striking face comprises a breaking portion inside. The breaking portion occupies about 80% of the area of the respective striking face. The breaking portion comprises at least two striking areas protruding from the respective striking face, thereby effectively striking and breaking hard objects.

Preferably, the breaking portion is a concentric circle area retracted a predetermined distance from a ring edge of the respective striking face.

Preferably, each striking area comprises a top, and an extension spirally and outwardly extending from the top.

Preferably, the tops of the at least two striking areas are located near the center of the respective striking face.

Preferably, the at least two striking areas are equidistantly symmetrically located near the center of the respective striking face.

Preferably, a gap is formed between two adjacent striking areas.

Preferably, the at least two striking areas are spirally arranged on the breaking portion.

Other advantages and features of the present invention will be fully understood by reference to the following specification in conjunction with the accompanying drawings, in which like reference signs denote like components of structure.

DETAILED DESCRIPTION OF THE INVENTION

The technical contents and features of the present invention will now be described hereinafter with reference to the accompanying drawings. Those skilled in the art can understand that the description terms of the preferred embodiment belong to a higher-level description that does not limit the application field of solar power generation modules, for example, hammer head structure or related technical terms include, but are not limited to, the manner specified in the description, the term location includes but is not limited to setting, approaching, connecting, or adjoining, and the number "a" of each component includes one and more than one component number. The directional adjectives such as "up", "down", "inside", "outside", "top", and "bottom" mentioned in the contents of this specification are merely illustrative description terms based on the normal use direction, not as the purpose of limiting the scope of the claims.

Figure 1:
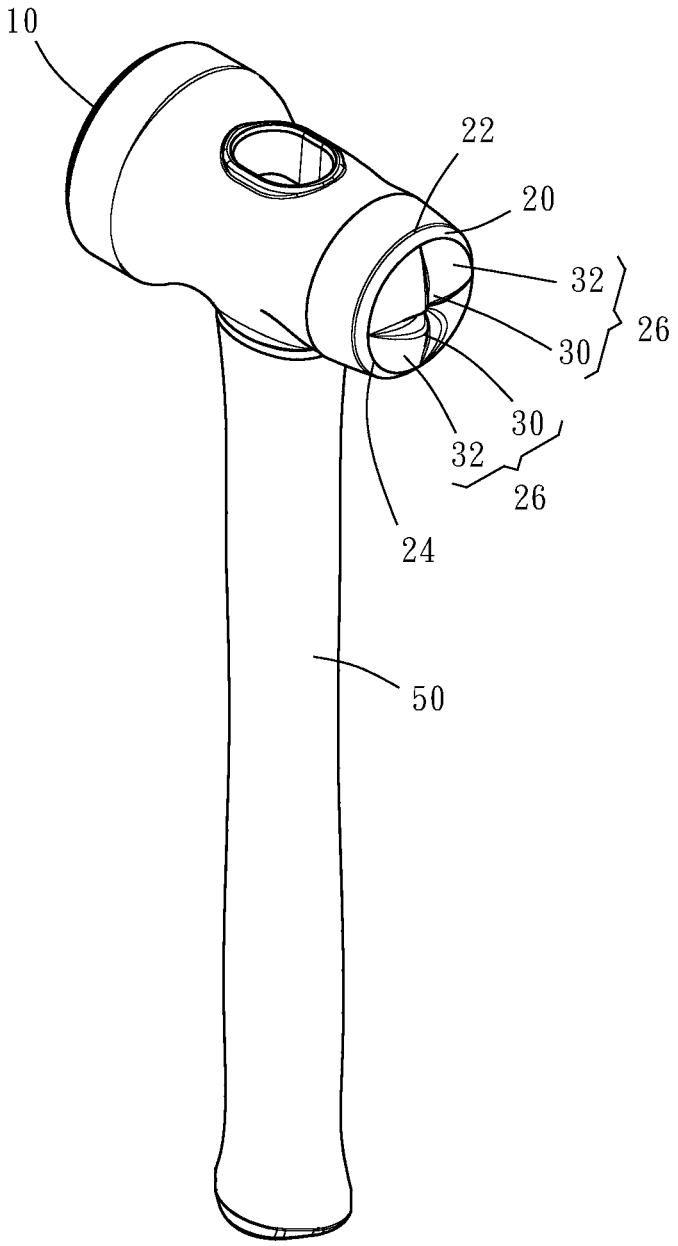
FIG. 1 is an oblique top elevational view of a breaker hammer in accordance with a preferred embodiment of the present invention.
Figure 2:
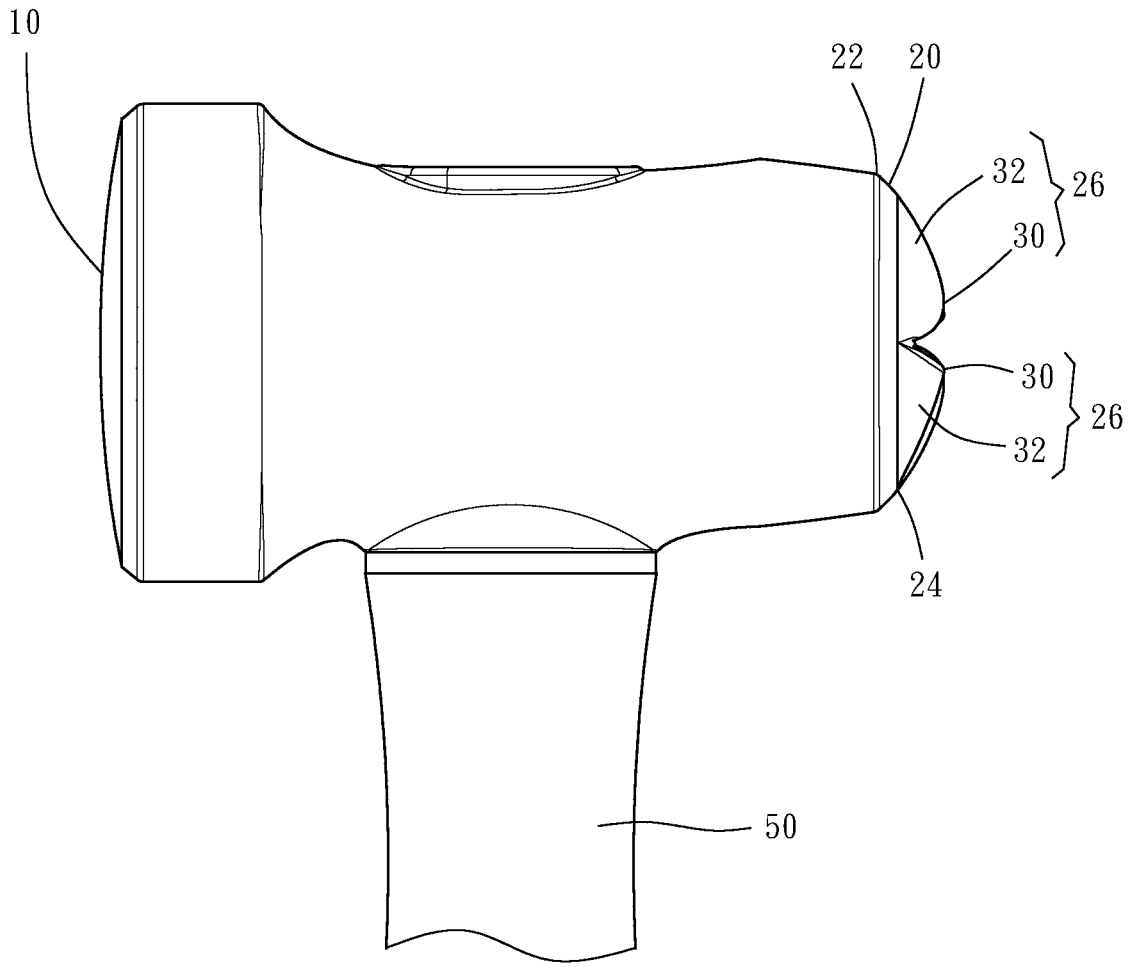
FIG. 2 is a front view of a part of the breaker hammer shown in FIG. 1.
Figure 3:
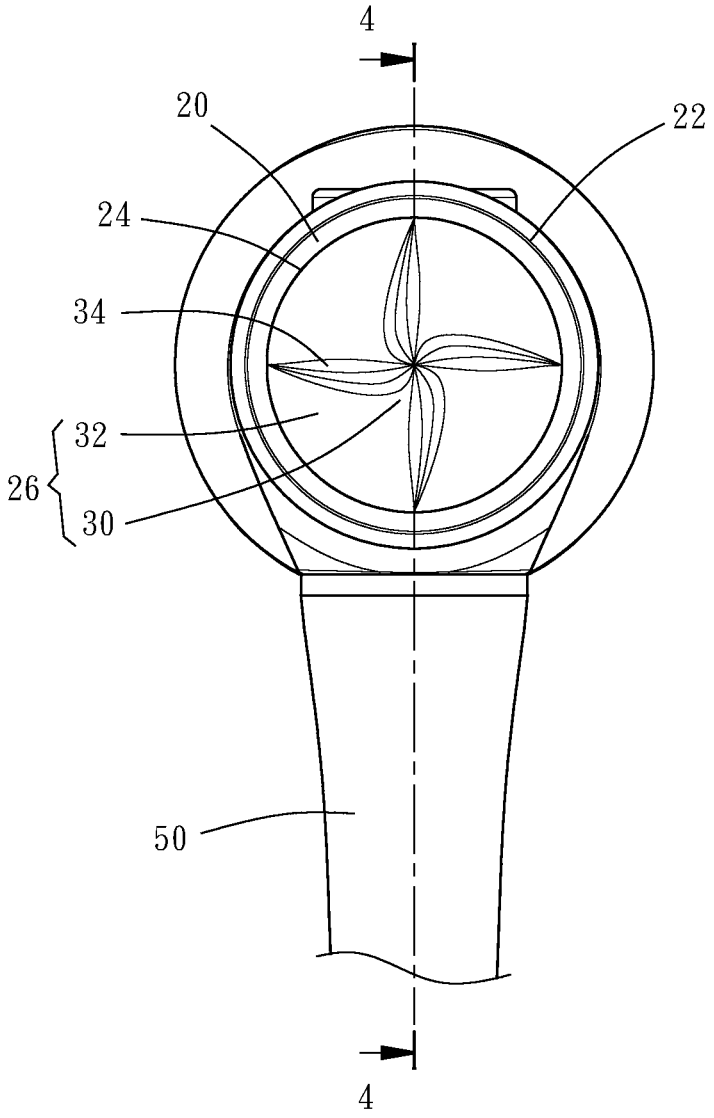
FIG. 3 is a side view of a part of the breaker hammer shown in FIG. 1.
Figure 4:
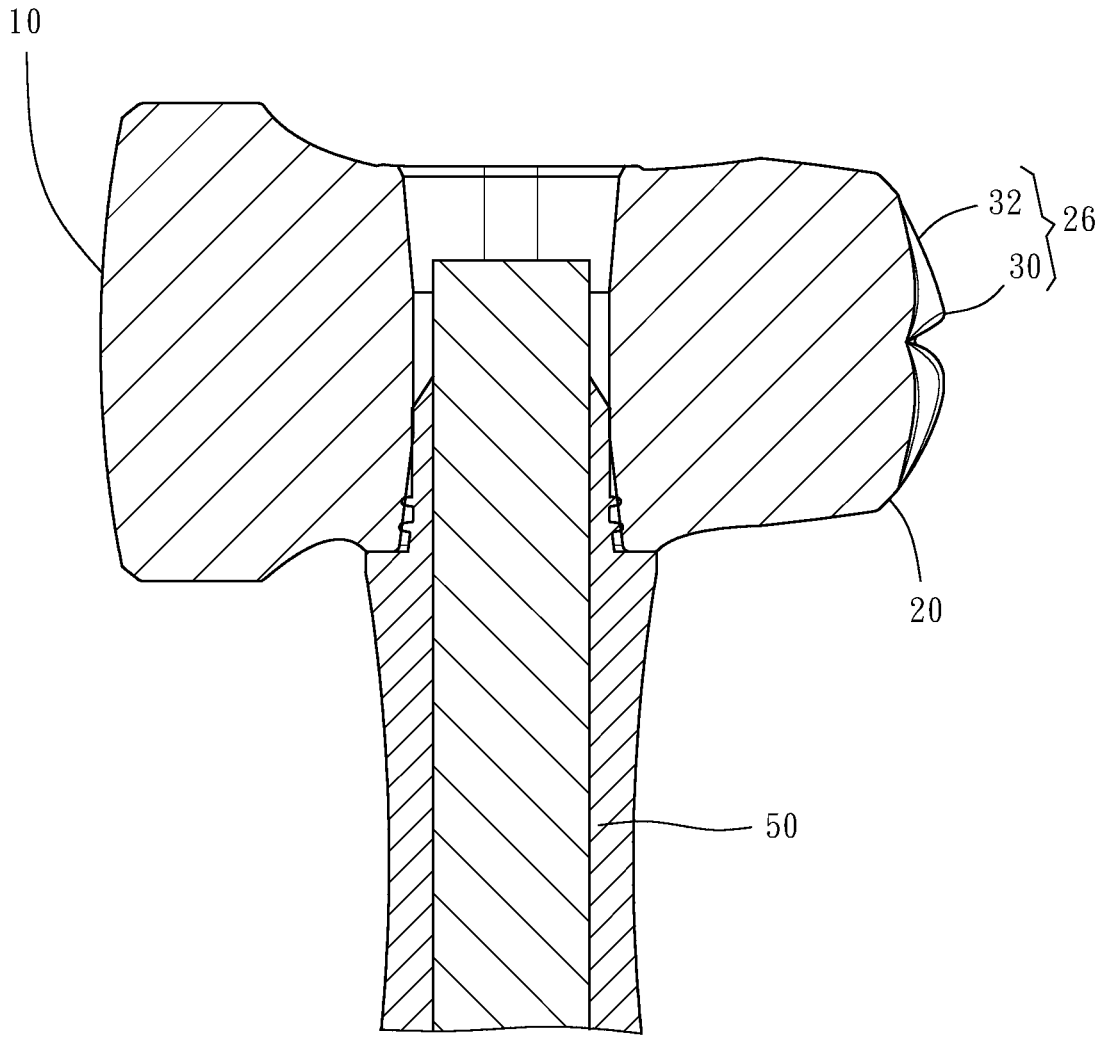
FIG. 4 is a sectional view taken along line 4-4 of FIG. 3.

As shown in FIG. 1 to FIG. 4, a breaker hammer for breaking hard objects provided by the preferred embodiment of the present invention is specifically an American sledgehammer as an example. The breaker hammer has a first striking face 10 and a second striking face 20. The first striking face 10 and the second striking face 20 are respectively disposed at two opposite sides of the head of the breaker hammer. The first striking face 10 of the present preferred embodiment is generally an arc surface, which is mainly used for striking general objects. A handle 50 is provided between the first striking face 10 and the second striking face 20 of the breaker hammer.

In the preferred embodiment, the second striking face 20 of the striker hammer is taken as an example with a substantially circular ring edge 22, and the ring edge 22 may also have other shapes such as a polygon or a special shape, so that the second striking face 20 can adjust the shape according to the actual application status. The second striking face 20 has a breaking portion 24 inside. The breaking portion 24 in the present preferred embodiment is mainly based on a concentric circle region with a predetermined distance retracted from the ring edge 22 toward the inside of the second striking face 20 as an example. The breaking portion 24 occupies approximately 80% of the area of the second striking face 20. Preferably, the breaking portion 24 may also occupy approximately 60-70% of the area of the second striking face 20, and the use and impact effects can be more concentrated and efficient.

The breaking portion 24 of the second striking face 20 has at least two striking areas 26, each striking area 26 protruding from the second striking face 20. Specifically, in the preferred embodiment, four stroking areas 26 are arranged on the breaking portion 24 at an equal distance and symmetrically as an example. Each striking area 26 has a top 30 and an extension 32 spirally extending from the top 30. The arrangement of the striking areas 26 in the present preferred embodiment is based on the tops 30 of the striking areas 26 being equidistantly symmetrically located near the center of the second striking face 20. The extension 32 of each striking area 26 extends from the associating top 30 to the ring edge 22 of the second striking face 20. A gap 34 is formed between the extensions 32 of two adjacent striking areas 26, and the overall striking areas 26 form a spiral and rotating structure at the breaking portion 24.

With the above-mentioned constituent members, when the second striking face 20 of the breaker hammer is used to strike hard objects such as stone objects, because of the design that each striking area 26 of the breaking portion 24 projects the second striking face 20, the striking areas 26 can contact the hard objects first. Using the top 30 of each striking area 26 to directly impact the surface of hard objects, the hard objects can be easily broken into pieces by the striking areas 26. Furthermore, each striking area 26 is centered on the center of the second striking face 20, which increases the instantaneous destructiveness when struck. The extensions 32 of striking areas 26 can increase the structural strength of striking areas 26 and further increase the destructive force. It can also use the spiral structure of the extensions 32 and each gap 34 to guide the debris generated after the destruction of hard objects to further increase the knock and damage effects of hard objects.

What is claimed is:

1. A breaker hammer for breaking objects, comprising a striking face comprising a breaking portion inside, said breaking portion comprising at least three striking areas protruding from the striking face;

wherein said breaking portion is a concentric circle area retracted a predetermined distance from a ring edge of the striking face;

wherein each of said at least three striking areas comprises a top, and an extension spirally and outwardly extending from said top;

wherein the tops of said at least three striking areas are located adjacent to a center of the striking face; and the tops protrude a greater distance from the striking face than a distance which the extensions protrude from the striking face;

wherein said at least three striking areas are equidistantly symmetrically located adjacent to the center of the striking face;

wherein a gap is formed between each adjacent two of said at least three striking areas;

wherein said at least three striking areas are spirally arranged on said breaking portion; and wherein each of the extensions comprises a first side at one of the gaps and a second side at another one of the gaps in a way that a height of the first sides is higher than a height of the second sides.

* * * * *